United States Patent [19]

Norden

[11] Patent Number: 4,810,212

[45] Date of Patent: Mar. 7, 1989

[54] TERMINAL BLOCKS FOR ONE-SIDE WIRE ENTRY AND SCREW ACCESS

[75] Inventor: Alexander R. Norden, New York, N.Y.

[73] Assignee: Connectron, Inc., Laurence Harbor, N.J.

[21] Appl. No.: 219,867

[22] Filed: Jun. 29, 1988

Related U.S. Application Data

[63] Continuation of Ser. No. 83,201, Aug. 10, 1987, abandoned.

[51] Int. Cl.[4] ..... H01R 4/42

[52] U.S. Cl. ..... 439/709; 439/810

[58] Field of Search ..... 439/810–814, 439/709–711, 807, 815

[56] References Cited

U.S. PATENT DOCUMENTS

| | | | |
|---|---|---|---|
| 2,097,470 | 11/1937 | Richardson | 173/259 |
| 2,193,691 | 3/1940 | Johnson et al. | 439/807 |
| 2,768,363 | 10/1956 | Haynes | 439/807 |
| 2,906,990 | 9/1959 | Cain et al. | 439/723 |
| 3,020,514 | 2/1962 | Butler | 439/807 |
| 3,072,879 | 1/1963 | Crowther | 439/709 |
| 3,253,251 | 5/1966 | Norden | 439/716 |
| 3,447,122 | 5/1969 | Beck | 439/727 |
| 3,464,055 | 8/1969 | Lescarboura | 439/733 |
| 3,539,977 | 11/1970 | Woertz | 439/811 |
| 3,803,534 | 4/1974 | Debaigt | 439/807 |
| 3,812,453 | 5/1974 | Kiessling | 439/806 |
| 4,027,939 | 6/1977 | White | 439/783 |
| 4,162,819 | 7/1979 | Eisert | 439/711 |
| 4,171,152 | 10/1979 | Geiseler | 439/811 |
| 4,178,057 | 12/1979 | McCormick | 174/65 R |
| 4,331,377 | 5/1982 | Ebbinghaus et al. | 439/811 |
| 4,415,222 | 11/1983 | Polidori | 439/807 |
| 4,619,497 | 10/1986 | Vogel et al. | 439/807 |
| 4,669,806 | 6/1987 | Fuchs | 439/813 |
| 4,693,542 | 9/1987 | Heng et al. | 439/810 |

FOREIGN PATENT DOCUMENTS

| | | | |
|---|---|---|---|
| 2201736 | 7/1973 | Fed. Rep. of Germany | 439/814 |
| 2370370 | 6/1978 | France | 439/811 |

*Primary Examiner*—Gary F. Paumen

[57] ABSTRACT

The disclosed electrical connection apparatus includes an enclosure of electrical insulation having a cavity containing a screw-activated clamp for gripping a wire against a contact member, the screw being accessible for operation at the wire-entry side of the enclosure.

20 Claims, 1 Drawing Sheet

FIG. 3
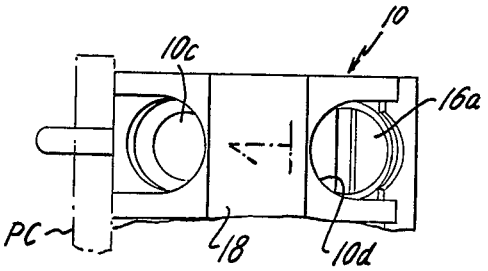
FIG. 1
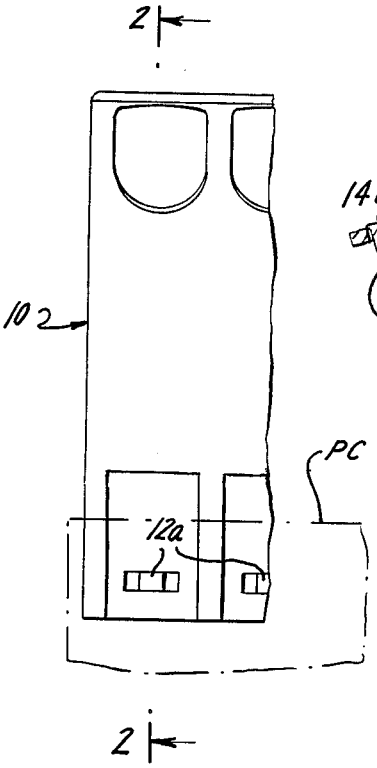
FIG. 4
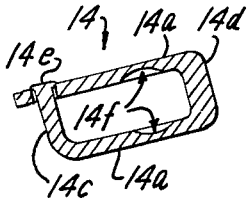
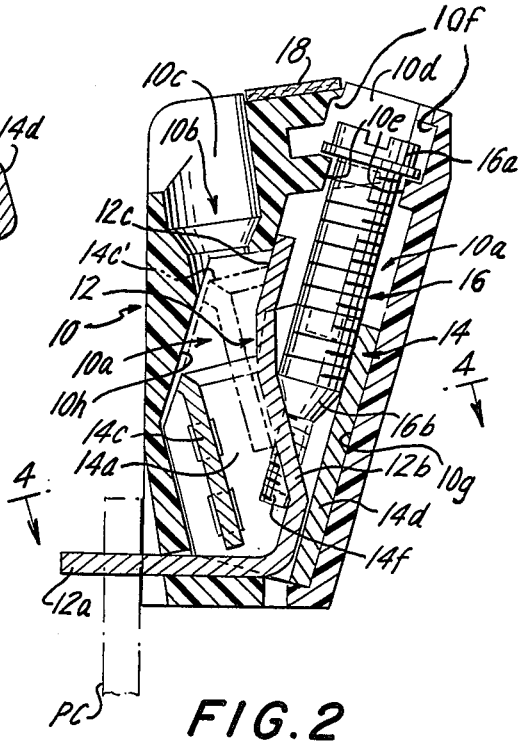
FIG. 2

TERMINAL BLOCKS FOR ONE-SIDE WIRE ENTRY AND SCREW ACCESS

This application is a continuation of my application Ser. No. 083,203 filed Aug. 10, 1987, now abandoned.

The present application relates to novel electrical terminal blocks, especially those having screw fasteners for wires, in which the screws are accessible for operation at the wire-entry side of the structure.

The present invention is discussed here and it is described below in relation to a terminal block for making connections to the terminals of a printed-circuit board ("P-C board") but, as will be readily understood, such terminal blocks may be used for other purposes in which a second set of wires (for example) replaces the P-C board.

Terminal connections to a printed circuit board may extend along one margin, or there may be multiple rows of connections along sides of the P-C board. Each connection should be highly dependable, and it should be reversible for releasing a wire that has once been secured to a P-C board terminal, so that another wire can be connected to that terminal of the P-C board. Moreover, the connection apparatus is to accommodate insertion of the wires at the same side where wire fasteners are to be accessible for operation by a screw-driver or other equivalent tool, e.g., an Allen wrench.

Many terminal blocks are known having wire securing devices operable to fasten or release an inserted wire at the wire entry side of the terminal block. Such terminal blocks may be compared—or contrasted—with the present novel terminal blocks. Known terminal blocks of the type required may be more expensive, bulky, complicated, etc. than those here involved, or they depend on a kind of wire fastener that does not instill a feeling in the user that the connections are highly stable and dependable, or are based on deformable nonreusable clamping members, or that, in operating the wire fasteners, undue stress may be developed at P-C board connections as the wire fasteners are being operated.

The exemplary terminal block described in detail below represents the presently preferred embodiment of the invention. Each wire fastener of that terminal block includes a screwoperated hollow clamp having one wall or jaw that shifts and clamps an inserted wire against one side of a contact member while the screw bears oppositely against the contact member. The wire and the screw both enter one end of the hollow in the clamping member, promoting operating access and wire entry at the same side of the terminal block. There is no tendency of the screw to become deflected due to the force it develops against the contact member because the screw is guided in the clamp in a manner that provides a deflection-nullifying reaction force. The contact member tends to stay in place as the screw fastener is being operated.

The nature of the invention including the foregoing and other aspects, some mentioned hereinafter, will be appreciated from the following detailed description of an illustrative embodiment which is shown in the accompanyign drawings.

In the drawings:

FIG. 1 is a fragmentary elevation of a novel terminal block, including part of a printed-circuit board shown in phantom;

FIG. 2 is a cross-section of the terminal block and the printed-circuit board as seen at the plane 2—2 of FIG. 1;

FIG. 3 is a fragmentary top plan view of the apparatus of FIG. 2; and

FIG. 4 is a cross-section of the clamp at the plane 4—4 in FIG. 2.

The terminal block includes a row of regularly spaced connecting devices only one of which is shown in FIGS. 2 and 3. (A fragment of a second connecting device appears in FIG. 1). Mount or enclosure 10 of electrical insulation provides an internal cavity **10*a* and a wire-entry passage 10*b* extending to an external opening 10*c*. A screw access opening 10*d* is also provided; both openings 10*c* and 10*d* are near each other, at the same side of mount 10**.

Contact member 12 disposed largely in cavity **10*a*, has an external terminal 12*a*, a contact portion 12*b* and a tail 12*c*. At the bottom of enclosure 10, contact member 12 extends through an opening in the enclosure so that the contact member cannot move straight down or straight up, and so that contact member 12 cannot pivot clockwise about the point, near terminal 12*a*, where the contact member emerges from the enclosure. Counterclockwise pivoting is blocked by engagement of tail 12*c*** with the enclosure.

Clamping member 14 (briefly "clamp") is a four-walled structure as of steel, including essentially parallel side walls **14*a* and spaced-apart end walls, i.e., jaw 14*c* and rear or bearing wall 14*d*. The end walls of the clamp diverge upward, in the direction of the common wire-entry and fastener-access side of the terminal block. Tangs 14*e* are staked in openings in one of the clamp's side walls, so that clamping member 14 is rigid and hollow. Screw threads 14*f* are swaged in opposite side walls 14*a*, close to bearing wall 14*d***.

Screw 16 has a head **16*a*, a conical end 16*b* remote from head 16*a* and, along its length, screw 16 is threaded and operable in screw threads 14*f* of the clamp. Screw threads 14*f* are close to rear wall 14*d* so that, in use, the threaded length of the screw bears against wall 14*d*. In a slight modification, screw threads 14*f* as shown in FIG. 4 would extend continuously from one side wall 14*a* to the other, across rear wall 14*d*. Side walls 14*a* and rear wall 14*d*** guide the clamp along the screw and provide the required screw threads.

Mount 10 comprises two molded parts at opposite sides of the screw 16 and provides shoulders **10*e* and 10*f*. Head 16*a* bears against shoulder 10*e* of the mount when the screw is turned in the tightening direction, in which it draws clamping member 14 upward. Accordingly, shoulder 10*e* resists inward thrust of a screw driver against the screw. A wire is inserted via opening 10*c*, and along passage 10*b* to the space between contact portion 12*b* of member 12 and jaw 14*c* of the clamp member. The inserted wire and contact portion 12*b* and jaw or wall 14*c* are parallel to each other and they extend at a small acute angle to the screw axis. This angle, about 30° in this example, is shown to scale in FIG. 2, which is otherwise enlarged. As the screw is tightened, wall 14*c* shifts upward and to the right, parallel to the screw's axis. One component of this motion is toward contact portion 12*b* and one component of motion is along the contact portion. As soon as jaw 14*c* presses a wire against contact portion 12*b*, the conical end 16*b* of the screw presses with equal force against the opposite side of contact portion 12*b*. In turn, the force of screw end 16*b* against contact portion 12*b* is balanced by the reaction of the screw mainly against wall 14*d* of the clamp. The clamping force developed by wall or jaw 14*c* and contact portion 12*b* is thus balanced by a reaction force of the screw against the contact portion; and this, in turn, is balanced by the bearing force that wall 14***d* provides for the screw. The wire-clamping stresses are thus contained within the four-wall metal clamping member 14. Smaller balanced forces develop along screw 16 between shoulder 10*e* and clamp 14.

Cavity 10 as seen in FIG. 2 has two opposite parallel surfaces 10*g* and 10*h* between which clamping member 14 is moved by screw 16. The wire clamping jaw is shown at nearly opposite extreme positions 14*c* and 14*c*'. In all positions of member 14, an ordinary wire inserted at opening 10*c* can only be admitted between contact member 12 and jaw 14*c*; it is blocked against entry behind jaw 14*c* (to the left of jaw 14*c*, 14*c*' in FIG. 2).

Screw 16 is captive in the insulation of enclosure 10. Shoulders 10*f* prevent removal of screw 16. Shoulders 10*f* also react against screw 16 when the screw is being unscrewed to release a wire. As the screw is being unscrewed, it bears against shoulders 10*f* and drives clamping member 14 downward, serving in a positive manner to release the clamping grip of a wire by parts 12*b* and 14*c*.

Downward shift of member 12 is blocked by engagement of contact member 12 (as shown) with the insulating mount; and upward shift of member 12 during tightening of the wire fastener is also blocked, in the manner described above. Consequently, the soldered (or other) joint of member 12 to an external circuit device is essentially isolated from stress and displacement. Obviously, positioning of contact member 12 in enclosure 10 could be modified for making it still more secure, if desired.

In an example, contact member 12 is a hard metal such as beryllium copper to resist deformation when screw 16 is being tightened. In this example, contact member 12 is 0.090 inch wide and 0.032 inch thick. Its end portion 12*a* is 0.040 inch wide where it passes through an opening in the P-C board PC. As usual, a metal foil or bonded film surrounds the opening in the P-C board where it is penetrated by each terminal 12*a*, and the joint is soldered at that point. That joint is not stressed in any significant degree as the connection device is tightened or loosened. A wire can be tightened in place, and another wire may be substituted if desired by loosening and re-tightening the wire fastener.

The wire-entry opening 10*c* and the nearby screw access opening 10*d* are at the same side of mount 10. Between those openings and on mount 10, there is a labeling strip 18.

It is evident that changes may be introduced in the described construction by those skilled in the art. For example, the wire enters the terminal block (as described above) along an angled path relative to the screw's axis, but cavity 10*c* may be rearranged to accommodate entry of a wire parallel to the screw's axis, such that a bend would form in the wire between the portion entering the terminal block and the wire's end portion that is gripped by parts 12*b* and 14*c*. Other modifications will be obvious. Consequently, the invention should be construed broadly in accordance with its true spirit and scope.

What is claimed is:

1. Electrical connection apparatus for a wire entering one side of the apparatus and fastened therein by manipulation at said one side of the apparatus, said apparatus comprising an enclosure of insulation having an internal cavity and a passage for entry of a wire into said cavity along a path of wire insertion via an opening at said one side of the apparatus, a contact member having a stationary contact portion in said cavity adjacent said path of wire insertion, a movable clamping member in said cavity having a jaw disposed opposite to a first side of said contact portion of the contact member, and a screw threaded in said movable clamping member and disposed to apply pressure to a second side of said contact portion opposite said first side thereof at a location opposite to said jaw, said screw extending at a maximum angle of about 30° to said path of wire insertion, said screw having an operating head disposed and accessible at said one side of said apparatus near said wire-entry opening, said screw having a portion cooperating with a fixed portion of the apparatus for arresting the screw against shifting along its axis when being operated so as to shift the clamping member toward the screw's head, said screw and said contact portion and said clamping member including the jaw thereof being so related that turning of the screw to shift the clamping member toward the screw head is also effective to draw the jaw along an oblique path toward said contact portion for gripping an inserted wire.

2. Electrical connection apparatus as in claim 1, wherein said screw has an end which is remote from said head and which bears against the side of said contact portion opposite said first side when the screw is being turned so as to draw said jaw toward said contact portion, said screw having an enlarged head and said enclosure having a shoulder against which said enlarged head bears when said screw is being operated for causing an inserted wire to be gripped, constituting said portion of the screw and said fixed portion of the apparatus cooperating therewith.

3. Electrical connection apparatus as in claim 1 wherein said clamping member provides a bearing wall against which the screw presses in balanced opposition to pressure of the screw against said contact portion.

4. Electrical connection apparatus as in claim 3, wherein said clamping member comprises a piece of sheet metal divided by three bends into a succession of four walls, the first and the last of the four walls being united by a joint, said walls including opposite trapezoidal side walls and oppositely slanted end walls, said jaw and said bearing wall constituting said end walls, at least said side walls having segmental screw threads formed therein for said screw.

5. Electrical connection apparatus as in claim 1 in which said contact portion of the contact member extends at about 30° to said screw axis.

6. Electrical connection apparatus for a wire entering one side of the apparatus and fastened therein by manipulation at said one side of the apparatus, said apparatus comprising an enclosure of insulation having an internal cavity and a passage for entry of a wire into said cavity along a path of wire insertion via an opening at said one side of the apparatus, a contact member having a stationary contact portion in said cavity adjacent said path of wire insertion, a movable clamping member in said cavity having a jaw disposed opposite to a first side of said contact portion of the contact member, and a screw threaded in said movable clamping member at a second side of said contact portion opposite said first side thereof, said screw having an operating head disposed and accessible at said one side of said apparatus near said wireentry opening, said screw having a portion cooperating with a fixed portion of the apparatus for arresting the screw against shifting along its axis when being operated so as to shift the clamping member toward the screw's head, said screw and said contact portion and said clamping member including the jaw thereof being so related that turning of the screw to shift the clamping member toward the screw head is also effective to draw the jaw along an oblique path toward said contact portion for gripping an inserted wire, said enclosure having a shoulder that cooperates with a portion of the screw for arresting the screw against axial outward displacement when the screw is being operated to release an inserted wire.

7. Electrical connection apparatus for a wire entering one side of the apparatus and fastened therein by manipulation at said one side of the apparatus, said apparatus comprising an enclosure of insulation having an internal cavity and a passage for entry of a wire into said cavity along a path of wire insertion via an opening at said one side of the apparatus, a movable clamping member in said cavity having spaced-apart side walls and having a jaw and a rear wall spaced apart and divergent from each other and extending between and unifying said side walls, and said clamping member having an open top, at least the side walls of the clamp having screw threads, a screw entering said clamping member via said open top and being in threaded cooperation with said screw threads and having an operating head accessible at said one side of the enclosure near said opening, and said apparatus having means for arresting the screw against moving axially outward when being turned for drawing the clamping member toward the screw's head, and a contact member fixed in position by said enclosure and having a stationary contact portion in said cavity in the space between said spaced-apart side walls and between said jaw and said rear wall, said contact portion extending at an acute angle across the screw's axis in position for engagement by the end of the screw remote from its head, said contact portion and said jaw being disposed at opposite sides of said path of wire insertion and said clamping member being operable by said screw so as to displace said jaw obliquely toward the contact portion for gripping an inserted wire.

8. Electrical connection apparatus as in claim 7, wherein the screw bears against said rear wall at least when a wire is being gripped so that the force of the jaw against an inserted wire which in turn forces the wire against said contact portion is balanced by the forces of the screw against the contact portion and against said rear wall.

9. Electrical connection apparatus as in claim 8, wherein said jaw and said rear wall have elongated portions that diverge in the direction of said one side of the enclosure.

10. Apparatus as in claim 7 wherein said enclosure provides a shoulder with which said head of the screw cooperates for arresting the screw against being shifted inward along its axis when the screw is being operated.

11. Electrical connection apparatus including an enclosure of electrical insulation having one side allocated to wire entry and fastener manipulation, said enclosure having an opening in said one side of admitting a wire along a wire path, a hollow screw-threaded clamping member contained movably in said enclosure and defined by spaced-apart walls which bound an open end, a screw having an enlarged tool-operable head accessible for operation from said one side of the enclosure, and a stationary contact member having a contact portion disposed in said hollow clamping member alongside said wire path, said screw extending into the hollow bounded by said spaced-apart walls and being threaded in said clamping member for drawing the clamping member along the screw, one wall of the clamping member being a jaw at the side of the wire path opposite said contact portion and movable obliquely toward the contact portion as the clamping member is drawn along the screw, said enclosure having a shoulder cooperable with said enlarged screw head for restraining the screw against axial inward movement relative to the enclosure while the screw is being operated for moving the jaw toward the contact portion.

12. Electrical connection apparatus as in claim 11, wherein the end of the screw remote from its head bears against the side of said contact portion opposite that where an inserted wire is gripped by said jaw.

13. Electrical connection apparatus as in claim 12, wherein a portion of said screw near said end develops pressure against said clamping member to balance the pressure of the screw against the contact portion when an inserted wire is gripped.

14. Electrical connection apparatus as in claim 11 wherein said hollow clamping member includes a wall engaged by the screw opposite to said contact portion for balancing the force imposed by the jaw via said contact portion against the screw.

15. Electrical connection apparatus including an enclosure of electrical insulation having one side allocated to wire entry and fastener manipulation, said enclosure having an opening in said one side for admitting a wire along a wire path, a hollow clamping member contained movably in said enclosure and defined by spaced-apart walls which bound an open end, a screw having a tool-operable head accessible for operation from said one side of the enclosure, and a stationary contact member having a contact portion disposed in said hollow clamping member alongside said wire path, said screw extending via said open end into the hollow of the clamping member bounded by said spaced-apart walls and being threaded in said clamping member for drawing the clamping member along the screw, one wall of the clamping member being a jaw at the side of the wire path opposite said contact portion and movable obliquely toward the contact portion as the clamping member is drawn along the screw, said apparatus having means for restraining the screw against inward axial movement relative to the enclosure when the screw is operated for moving the jaw toward the contact portion, said enclosure having a shoulder engageable by a portion of the screw for arresting the screw against outward axial motion when the screw is turned in the wire-releasing direction so that the screw drives the clamping member in the wire-releasing direction.

16. Electrical connection apparatus for a wire entering one side of the apparatus and fastened therein by manipulation at said one side of the apparatus, said apparatus comprising an enclosure of insulation having an internal cavity and a passage for entry of a wire into said cavity along a path of wire insertion via an opening at said one side of the apparatus, a contact member having a stationary contact portion in said cavity adjacent said path of wire insertion, a movable clamping member in said cavity having a jaw disposed at a first side of said contact portion of the contact member, and a screw threaded in said movable clamping member at a second side of said contact portion opposite said first side thereof, said screw having an opeating head disposed and accessible at said one side of said apparatus near said wire-entry opening, said screw having a portion cooperating with a fixed portion of the apparatus for arresting the screw against shifting alongs its axis when being operated so as to shift the clamping member toward the screw's head, said screw and said contact portion and said clamping member including the jaw thereof being so related that turning of the screw to shift the clamping member toward the screw head is also effective to draw the jaw along an oblique path toward said contact portion for gripping an inserted wire, said enclosure limiting insertion of a wire to the space between the jaw and said contact portion in all adjusted positions of the jaw.

17. Electrical connection apparatus for a wire entering one side of the apparatus and fastened therein by manipulation at said one side of the apparatus, said apparatus comprising an enclosure of insulation having an internal cavity and a passage for entry of a wire into said cavity along a path of wire insertion via an opening at said one side of the apparatus, a contact member having a stationary contact portion in said cavity adjacent said path of wire insertion, a movable clamping member in said cavity having a jaw disposed at a first side of said contact portion of the contact member, and a screw threaded in said movable clamping member at a second side of said contact portion opposite said first side thereof, said screw having an operating head disposed and accessible at said one side of said apparatus near said wire-entry opening, said screw having a portion cooperating with a fixed portion of the apparatus for arresting the screw against shifting along its axis when being operated so as to shift the clamping member toward the screw's head, said screw and said contact portion and said clamping member including the jaw thereof being so related that turning of the screw to shift the clamping member toward the screw head is also effective to draw thejaw along an oblique path toward said contact portion for gripping an inserted wire, said clamping member having two mutually opposite side walls and two upward-divergent end walls one of which constitutes said jaw, said clamping member having an open top into which said screw extends and into which a wire is admitted, at least said mutually opposite side walls providing screw threads for said screw.

18. A terminal block for one-side wire entry and tool operation, said apparatus including a wire fastener including a screw, an insulating enclosure having an internal cavity containing said wire fastener, a wire-admitting passage extending to said cavity and having a first opening at one external side of the enclosure, said enclosure also having a second opening at said one side for access to said screw for its manipulation, and said wire fastener further including a four-wall clamping member having an open top and being open at the bottom, said top and bottom of the clamping member being respectively nearer to and farther away from one side of the enclosure, and said clamping member having opposite side walls and having first and second end walls securely fixing the side walls against separating displacement, said first end wall extending along part of said screw, and said side walls having respective rows of screwthread segments extending parallel to said first end wall for cooperation with the screw, said second end wall diverging relative to said first end wall in the direction of said one side of the enclosure, and a terminal member having an elongated contact portion in said clamping member parallel to said second end wall and extending slantwise at an acute angle relative to the axis of said screw, the foregoing arranged so that turning the screw in one direction while the end of the screw bears against one side of the contact portion draws the clamping member generally toward said one side of the enclosure and draws said second end wall obliquely toward said contact portion for gripping an inserted wire.

19. A terminal block as in claim 18, wherein said enclosure is related to said wire fastener so as to block insertion of a wire at the side of said second end wall remote from said elongated contact portion.

20. A terminal block as in claim 18, wherein said acute angle is approximately 30°.

* * * * *